United States Patent [19]

Maekawa et al.

[11] 4,091,376

[45] May 23, 1978

[54] DRIVING CIRCUITS FOR A MULTI-DIGIT GAS DISCHARGE PANEL

[75] Inventors: Koji Maekawa, Yamatokoriyama; Iwao Hamasaki, Miyazaki, both of Japan

[73] Assignee: Sharp Kabushiki Kaisha, Osaka, Japan

[21] Appl. No.: 712,043

[22] Filed: Aug. 6, 1976

[30] Foreign Application Priority Data

Aug. 13, 1975 Japan ..... 50/98700

[51] Int. Cl.[2] ..... G09F 9/00

[52] U.S. Cl. ..... 340/336; 313/484; 315/167 R; 340/324 R; 340/343

[58] Field of Search ..... 340/343; 340/166 EL, 340/168 S, 324 R, 324 M, 336, 343; 235/60.28, 60.32, 60.34; 315/169 TV, 169 R; 313/484, 514, 517, 519

[56] References Cited

U.S. PATENT DOCUMENTS

| | | | |
|---|---|---|---|
| 3,449,726 | 6/1969 | Kawamoto et al. | 340/324 R |
| 3,646,544 | 2/1972 | Yamaguchi | 340/324 R |
| 3,924,112 | 12/1975 | Kashio | 340/336 |
| 3,992,577 | 11/1976 | Amano et al. | 340/324 M |
| 4,001,809 | 1/1977 | Fukui et al. | 340/324 M |

*Primary Examiner*—Marshall M. Curtis

*Attorney, Agent, or Firm*—Birch, Stewart, Kolasch & Birch

[57] ABSTRACT

A display energizing circuit associated with calculators for displaying on a time sharing basis numerical or alphanumerical symbols on a multi-digit gas discharge panel. Means are provided for preventing segment signals from being applied to segment electrodes or cathode electrodes of the gas discharge panel at one or more dead digit times which are provided within a one-word time period for other purposes. This avoids damage to circuit elements in the display energizing circuit, for example, switching transistor elements associated with counter electrodes or anode electrodes of the display panel.

3 Claims, 7 Drawing Figures

DRIVING CIRCUITS FOR A MULTI-DIGIT GAS DISCHARGE PANEL

BACKGROUND OF THE INVENTION 1. Field of the Invention

The present invention relates to a display energizing circuit for energizing a multi-digit display panel on a time sharing basis.

2. History of the Prior Art

In the past, to energize a gas discharge panel, it was required that switching elements associated with anode electrodes be of a relatively high break-down voltage. To this end, expensive and large-sized driving circuits are inevitably required. In the case where the driving circuits are composed of field effect transistors or bipolar transistors, they should also be of a high break-down voltage in view of their circuit characteristics. That is, break-down or destruction will occur in the transistors when more than the break-down voltage is applied to the transistors.

SUMMARY OF THE INVENTION

Accordingly, it is an object of the present invention to provide an improvement in driving circuits for energizing a multi-digit gas discharge panel which can avoid the above discussed shortcomings.

An important feature of the present invention is the inclusion of control means for preventing segment signals from being applied to segment electrodes or cathode electrodes of a gas discharge display panel during one or more dead time periods, that is, time periods not associated with displaying purposes. When energizing the gas discharge panel, a voltage level of more than the break-down voltage sought to be applied across the emitter-to-collector paths of switching transistors (field effect transistors or bipolar transistors) on its anode side is blocked to thereby preclude switching element destruction.

BRIEF DESCRIPTION OF THE DRAWING

A better understanding of the present invention may be had from a consideration of the following detailed description taken in conjunction with the accompanying drawing in which.

DETAILED DESCRIPTION OF THE INVENTION

To facilitate understanding of the concept of the present invention, the next succeeding paragraph sets forth break-down phenomena which will occur in a conventional driving circuit.

Figure 1:
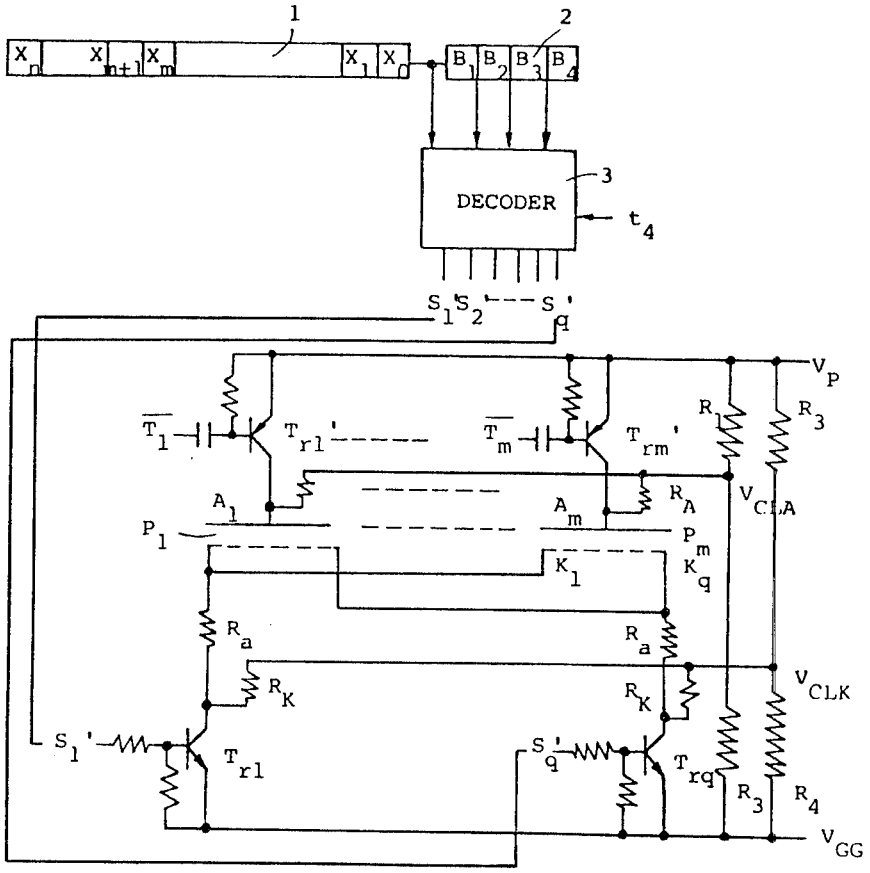
FIG. 1 is a circuit diagram illustrating a conventional driving circuit.

In FIG. 1, the contents $X_0 - X_n$ (the contents $X_0 - X_m$ are to be displayed, wherein $n > m$) of a display register 1 are transferred via a buffer register 2 of $B_1 - B_4$ into a decoder 3. The contents $X_0 - X_n$ of the display register 1 are recirculated and held in synchronization with timing signals $T_0 - T_n$. The outputs from the decoder 3 or segment signals $S_1' - S_q'$ are entered into a driving circuit, that is, the bases of respective switching elements $T_{r1} - T_{rq}$ on the cathode side of a gas filled multi-digit display panel.

The gas filled multi-digit display panel for displaying a succession of numerical or alphanumerical symbols contains digit display units $P_1 - P_m$ each having a single anode terminal A ($A_1 - A_m$) and a predetermined number of segmented cathode terminals $K_1 - K_q$. While switching transistors $T_{r1}' - T_{rm}'$ are provided for the anode terminals A, switching transistors $T_{r1} - T_{rq}$ are provided for controlling the cathode terminals $K_1 - K_q$.

Figure 2:
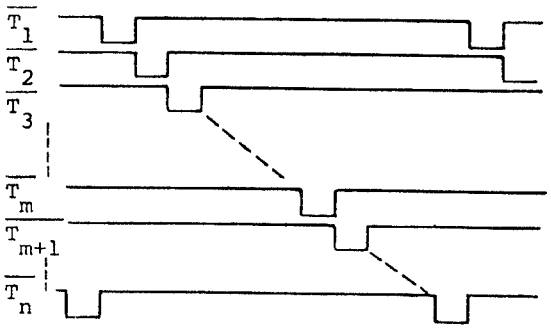
FIG. 2 is a timing diagram illustrating timing signals which occur in the circuit of FIG. 1.

The switching elements $T_{r1}' - T_{rm}'$ on the anode side receive at their bases timing signals as illustrated in FIG. 2. A total of these timing signals $T_1 - T_n$ defines a one-word time period and, as well known in the art of electronic calculators, a display sequence is taking place during the period from $\overline{T_1}$ to $\overline{T_m}$ and the remaining time periods $\overline{T_{m+1}} - \overline{T_n}$ are established for other purposes, for example, overflow processing, negative sign processing and round processing which are necessary for calculations. These timing periods $\overline{T_{m+1}} - \overline{T_n}$ may be termed "dead times" for the purposes of displaying. In other words, in the calculator technique, display is carried out during the period $\overline{T_1} - \overline{T_m}$ but not during the dead period $\overline{T_{m+1}} - \overline{T_n}$, although calculation is carried out during the period $\overline{T_1} - \overline{T_n}$. See, for example, the U.S. Pat. No. 3,892,957 to John D. Bryant, "DIGIT MASK LOGIC COMBINED WITH SEQUENTIALLY ADDRESSED MEMORY IN ELECTRONIC CALCULATOR CHIP", column 5, line 35.

When it is desired to turn on the discharge display panel $P_1 - P_m$, for example, a voltage level at the anode terminal A is permitted to change from the potential $V_{CLA}$ (about 100V) to the potential $V_P$ (about 200V) but voltage levels at the cathode terminals $K_1 - K_q$ fall from the potential $V_{CLK}$ (about 100V) to the potential $V_{GG}$ (OV). As a result, a gaseous discharge occurs between the anode terminal A and the cathode terminals $K_1 - K_q$.

For example, when the specific timing signal $\overline{T_1}$ is impressed on the switching element $T_{r1}'$, the switching element $T_{r1}'$ is on and the remaining switching elements $T_{r2}' - T_{rm}'$ are all off At this time the output signal $S_1'$ from the decoder 3 is entered into the base of the switching element $T_{r1}$ on the cathode side. Gaseous discharge will be carried out with respect to the cathode terminal $K_1$.

Under these circumstances, the anode terminals $A_2 - A_m$ are clamped with the potential $D_{CLA}[(V_P - V_{CLA}) < V_{CE}$ wherein $V_{CE}$ is the emitter-collector break-down voltage of the switching elements $T_{r1}' - T_{rm}']$ such that the possibility of damaging the switching elements $T_{r2}' - T_{rm}'$ is precluded.

Meantime, during the dead time periods, that is, the periods $\overline{T_{m+1}} - \overline{T_n}$ not serving for display purposes, all the switching elements $T_{r1}' - T_{rm}'$ for controlling the anode terminals $A_1 - A_m$ stand at their off states. If information not desired to be displayed is stored in the portion $X_{m+1} - X_n$ of the display register 1, it will be developed at the decoder 3 and then the base of any specific switching element $T_{r1} - T_{rq}$ on the cathode side to thereby force that element into its on state.

In this instance, a differentiation circuit is formed by capacitance between tha anode terminals and the cathode terminals. In other words, as viewed from FIGS. 4(A) and 4(B), the voltage level of the anode terminals $A_1 - A_m$ take a differentiation waveform of which the peak is about $V_{GG}$. Consequently, a voltage higher than the break-down voltage will be applied between the emitters and the collectors of the switching elements $T_{r1}' - T_{rm}'$. This produces the possibility of damaging the switching elements $T_{r1}' - T_{rm}'$.

Figure 3A:
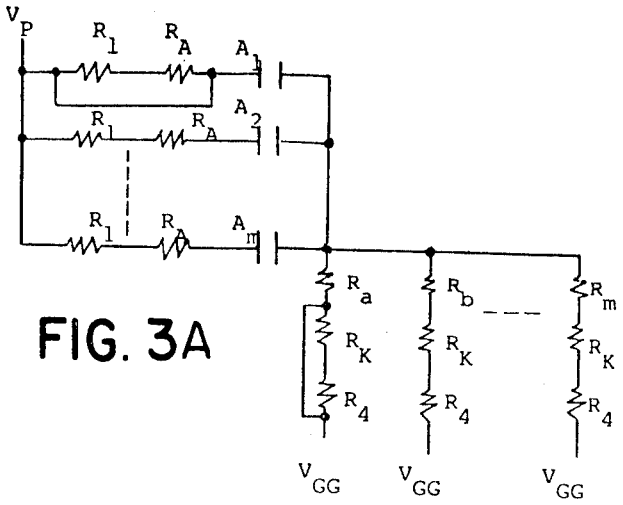
FIGS. 3(A), 3(B), 4(A) and 4(B) are explanatory diagrams illustrating the concept of the present invention.
Figure 3B:
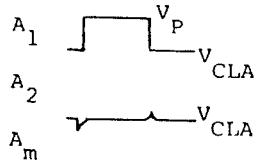
Figure 4A:
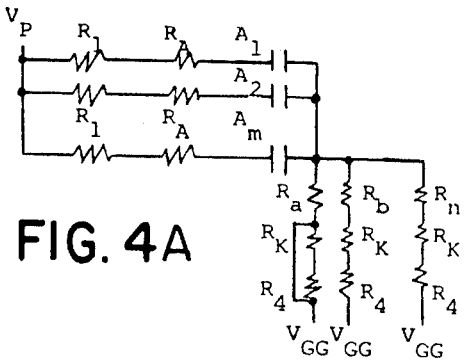
Figure 4B:
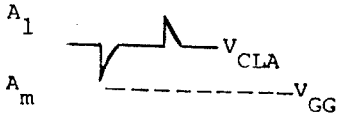

FIGS. 3(A) and 3(B) illustrate an equivalent circuit and waveforms developing in the circuit during the display time periods $\overline{T_1} - \overline{T_m}$, whereas FIGS. 4(A) and 4(B) illustrate the same during the dead time periods $\overline{T_{m+1}} - \overline{T_n}$.

In this way, the above outlined driving circuit requires high break-down voltage transistors and thus creates the problem that commercially available field effect transistors or bipolar transistors can not be used as the switching elements.

In accordance with the driving circuit of the present invention, in order to prevent more than the break-down voltage from being applied to the switching elements $T_{r1}' - T_{rm}'$, control means for preventing the generation of the segment signals at the cathode terminals are provided to preclude forcing the cathode switching elements $T_{r1} - T_{rq}$ into their on states in reply to the outputs from the decoder, even if information is contained within the region $X_{m+1} - X_n$ of the register X during the dead time periods.

Figure 5:
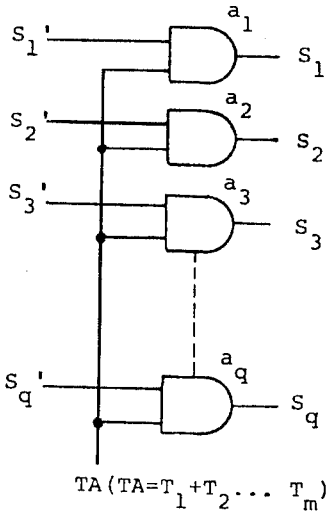
FIG. 5 is a logic diagram illustrating control means constructed in accordance with the present invention.

The control means of the present invention, as illustrated in FIG. 5, comprise AND gates $a_1 - a_q$ responsive to the output signals $S_1' - S_q'$ from the decoder 3. The other inputs to the AND gates $a_1 - a_q$ are the timing signal TA $(\overline{T_1} + \overline{T_2} \ldots \overline{T_m})$. The outputs $S_1 - S_q$ of these AND gates $a_1 - a_q$ are respectively supplied to the bases of the cathode switching elements $T_{r1} - T_{rm}$. The input TA means the logical sum of the timing signals $\overline{T_1} - \overline{T_m}$ during the display digit periods (not inclusive the timing signals $\overline{T_{m+1}} - \overline{T_n}$ during the dead periods).

Therefore, even though the display register 1 contains at its non-display digit positions $X_{m+1} - X_n$ information during the dead time periods $\overline{T_{m+1}} - \overline{T_n}$, the AND gates $a_1 - a_q$ do not receive the logical sum TA $(\overline{T_1} + \overline{T_2} \ldots \overline{T_m})$ of the timing signals. It follows that the gates are placed into their closed states and the outputs $S_1 - S_q$ are not provided for the switching elements $T_{r1} - T_{rq}$. In other words, the outputs of the AND gates $a_1 - a_q$ are produced during only the periods $\overline{T_1} - \overline{T_m}$.

To this end, during the dead digit time periods $\overline{T_{m+1}} - \overline{T_n}$, the differentiation circuit will not be formed by the capacitance between tha anode terminals and the cathode terminals nor will more than break-down voltage be applied between the emitters and the collectors of the switching elements $T_{r1}' - T_{rm}'$.

Although there has been described above a specific arrangement of the display driving circuits in accordance with the invention for the purpose of illustrating the manner in which the invention may be used to advantage, it will be appreciated that the invention is not limited thereto. Accordingly, any modifications, variations or equivalent arrangements which may occur to those skilled in the art should be considered to be within the scope of the invention.

What is claimed is:

1. In combination with a driving circuit for energizing a display means to display $m$-digit numerical or alpha-numerical symbols thereon in accordance with information contained within an $n$-digit storage means wherein $m < n$ and wherein during a succession of digit time periods $\overline{T_1}$ to $\overline{T_n}$ inclusive of one or more dead time periods $\overline{T_{m+1}}$ to $\overline{T_n}$ when no display of information is desired, said display panel including a gas-filled segmented discharge panel with a plurality ($m$) of display units each having an anode terminal and a plurality ($q$) of segmented cathode terminals, decoder means for transferring information from said storage means to said discharge panel, a plurality ($m$) of semiconductor switching means coupling said decoder means to the respective anodes and a plurality ($q$) of semiconductor switching means coupling said decoder means to the respective cathodes, said semiconductor switching means controlling the display of the $m$-digit numerical or alphanumerical symbols on a time-sharing basis in response to a plurality ($m$) of digit time signals $\overline{T_1}$ to $\overline{T_m}$, the improvement comprising:

blocking means for precluding the application of information from said decoder means to said display panel during said dead digit time periods $\overline{T_{m+1}}$ to $\overline{T_n}$.

2. The invention of claim 1, wherein said blocking means includes a plurality of AND gates corresponding in number to said plurality ($q$) of cathodes, the outputs of said AND gates being respectively coupled to said cathodes through a respective one of said plurality ($q$) of semiconductor switches, one input of each AND gate being connected to receive the logical sum of said digit timing signals $\overline{T_1}$ to $\overline{T_m}$, and the other input being connected to receive signals from said decoder means, whereby in the absence of the logical sum of said timing signals $\overline{T_1}$ to $\overline{T_m}$ at the said one input of said AND gates during said dead digit time period said AND gates block the passage of any signals from said decoder means to said display means.

3. The invention of claim 1, wherein said blocking means blocks the passage of information to said display means in the absence of the application of the logical sum of said digit time signals $\overline{T_1}$ to $\overline{T_m}$ to said blocking means.

* * * * *